US006279160B1

(12) United States Patent
Chen

(10) Patent No.: US 6,279,160 B1
(45) Date of Patent: Aug. 28, 2001

(54) KNEE AND ELBOW PROTECTOR

(75) Inventor: Chih-Cherng Chen, Taipei (TW)

(73) Assignee: Asics Corp, Kobe (JP)

( * ) Notice: Subject to any disclaimer, the term of this patent is extended or adjusted under 35 U.S.C. 154(b) by 0 days.

(21) Appl. No.: 09/498,368

(22) Filed: Feb. 4, 2000

Related U.S. Application Data

(63) Continuation-in-part of application No. 29/102,696, filed on Mar. 30, 1999, which is a continuation-in-part of application No. 29/101,948, filed on Mar. 15, 1999.

(51) Int. Cl.[7] ..... A41F 13/00; A41D 13/06

(52) U.S. Cl. ..... 2/24; 2/455; 602/62

(58) Field of Search ..... 2/16, 22, 24, 242, 2/911, DIG. 3, 455, 23; 602/6, 26, 62, 63; 128/881, 882

(56) References Cited

U.S. PATENT DOCUMENTS

| | | |
|---|---|---|
| D. 327,961 | 7/1992 | Decker . |
| D. 341,005 | 11/1993 | Pratt . |
| D. 341,229 | 11/1993 | Tsujino . |
| D. 360,284 | 7/1995 | Paffett et al. . |
| D. 360,285 | 7/1995 | Paffett et al. . |
| D. 360,286 | 7/1995 | Paffett et al. . |

(List continued on next page.)

*Primary Examiner*—John J. Calvert
*Assistant Examiner*—Tejash Patel
(74) *Attorney, Agent, or Firm*—Michael Zall

(57) ABSTRACT

A joint protector used for protecting an extremity of a person. The protector is predominantly used as a knee and elbow protector. The protector comprises a generally cylindrical elastic member having an outer surface, an inner surface, an upper opening and a lower opening. The elastic member is of a size such that when the extremity is slipped through the upper and lower openings the elastic member snugly encloses the extremity and joint and is held firmly in place thereon. A pocket enclosure is provided that is located intermediate the outer surface and the inner surface at a location in the elastic member that overlies the joint when the elastic member is slipped over the extremity. A cushioning assembly is provided for cushioning the joint upon impact. The cushioning assembly is located and secured in the pocket enclosure, the pocket enclosure substantially conforming to the shape of the cushioning assembly. The cushioning assembly has an interior surface and an exterior surface, the interior surface being closest to the extremity and joint being protected. The cushioning assembly preferably also includes a central cushioning pad portion having a silicon gel cushioning insert on the interior surface of the pad. The assembly additionally has a top cushioning flap, a bottom cushioning flap, a right side cushioning flap, and a left side cushioning flap radiating from and integral with the central portion. The interior surface of the central portion is shaped to substantially conform to the contour of the joint when snugly covering the joint.

When the protector is slipped over the persons extremity the interior surface of the central pad cushioning portion of the cushioning assembly and, preferably, the silicon gel cushioning insert over lay the joint of the person and the coaction of the cylindrical elastic member, and all of the cushioning flaps causes the cushioning assembly to surround and conform to the contour of the joint to provide protection against both direct and oblique impacts to the joint.

Preferably each cushioning flap has a plurality of apertures that penetrate completely through the cushioning flap. This has the effect of increasing the flexibility of the cushioning flap members as well as their porosity to sweat and the like.

Additionally, the pocket enclosure may include an opening to permit the foam protective element assembly to be removed, which would permit the elastic sleeve to be washed.

4 Claims, 8 Drawing Sheets

U.S. PATENT DOCUMENTS

| | | | | |
|---|---|---|---|---|
| D. 360,287 | | 7/1995 | Paffett et al. . | |
| D. 363,147 | | 10/1995 | Chen . | |
| D. 394,332 | | 5/1998 | Tsujino . | |
| D. 394,333 | | 5/1998 | Tsujino . | |
| 2,641,761 | | 6/1953 | Schultz . | |
| 3,044,075 | | 7/1962 | Rawlings . | |
| 3,322,118 | * | 5/1967 | Sotherlin | 2/24 |
| 3,322,873 | | 5/1967 | Hitchcock . | |
| 3,670,725 | | 6/1972 | Gaylord . | |
| 4,250,578 | | 2/1981 | Barlow . | |
| 4,287,885 | | 9/1981 | Applegate . | |
| 4,292,263 | * | 9/1981 | Hanrahan et al. | 264/46.9 |
| 4,354,280 | | 10/1982 | Hayes . | |
| 4,484,361 | | 11/1984 | Leighton et al. . | |
| 4,573,216 | | 3/1986 | Wortberg . | |
| 4,700,698 | | 10/1987 | Kleylein . | |
| 4,723,322 | | 2/1988 | Shelby . | |
| 4,796,303 | | 1/1989 | Atwater . | |
| 4,846,819 | | 7/1989 | Welch . | |
| 4,870,956 | | 10/1989 | Fatool et al. . | |
| 5,077,837 | | 1/1992 | Meistrell . | |
| 5,105,473 | | 4/1992 | Valtakari . | |
| 5,255,391 | * | 10/1993 | Levine | 2/24 |
| 5,306,229 | | 4/1994 | Brandt et al. . | |
| 5,411,037 | | 5/1995 | Hess et al. . | |
| 5,474,524 | | 12/1995 | Carey . | |
| 5,680,657 | | 10/1997 | Valtakari . | |
| 5,683,286 | | 11/1997 | Kielland . | |
| 5,685,021 | | 11/1997 | Tsujino . | |
| 5,695,452 | | 12/1997 | Grim et al. . | |
| 5,769,809 | | 6/1998 | Witzel . | |
| 6,055,676 | * | 5/2000 | Bainbridge et al. | 2/456 |
| 6,058,505 | * | 5/2000 | Bettencourt | 2/24 |

* cited by examiner

KNEE AND ELBOW PROTECTOR

RELATED APPLICATIONS

This application is a Continuation-in-Part of copending applications U.S. Ser. No. 29/102,696 (3.1-015) filed Mar. 30, 1999 and Ser. No. 29/101,948 (3.1-016) filed on Mar. 15, 1999.

BACKGROUND OF THE INVENTION

1. Field of the Invention

The present invention relates to protective knee and elbow protectors employed by athletes and the like, particularly adapted to prevent injuries to the knee and the proximal anatomical structure associated therewith.

2. Description of the Prior Art

Various knee and elbow protector devices are known in the art. It has been found that by placing a protector element atop the kneecap, injuries sustained in physical activity are reduced. Further, it has been determined by using such devices, the incidence of aggravating a current injury is also reduced. As such, knee and elbow protector devices are beneficial in the sport and athletic arts.

Examples of knee and elbow protector protectors and other protector devices for use during athletic activity are described in the following U.S. Patents:

U.S. Pat. No. 2,641,761 to Schultz discloses a knee brace or stabilizer.

U.S. Pat. No. 3,044,075 to Rawlings discloses a protective device to protect the wearer at impact points.

U.S. Pat. No. 3,322,873 to Hitchcock discloses a resilient body protector for use over various portions of the body.

U.S. Pat. No. 3,670,725 to Gaylord discloses a protective pad to be employed generally with jointed portions of the body. This pad would be placed atop the jointed element to prevent debilitating bedsores and ulceration.

U.S. Pat. No. 4,250,570 to Barlow discloses a protective knee support.

U.S. Pat. No. 4,287,885 to to Applegate discloses a knee brace with a resilient pad for surrounding the patella. There exists no central pad, merely a central opening to receive the extended portion of the patella therethrough.

U.S. Pat. No. 4,354,280 Hayes discloses a contact sport joint protector.

U.S. Pat. No. 4,484,361 to Leighton discloses a knee and elbow pad and a method of manufacturing the same.

U.S. Pat. No. 4,573,216 to Wortbeg discloses an impact dissipater to protect bones from impacts or falls. This device is primarily designed to be used proximal the bony region of the hip portion of the body.

U.S. Pat. No. 4,700,698 to Aleylein discloses a knee orthosis. This device includes a right and a left lateral extension which is integral to the elastic cylindrical element. The device does not include a central foam element nor does it include an upper or lower lateral extension.

U.S. Pat. No. 4,723,322 to Shelby discloses a knee pad.

U.S. Pat. No. 4,796,303 Atwater discloses a knee protector pad.

U.S. Pat. No. 4,870,956 to Fatool discloses a knee brace.

U.S. Pat. No. 5,077,837 to Meistrell discloses a knee or elbow protector.

U.S. Pat. No. 5,105,473 to Valtakwi discloses an athletic outfit having pockets for protective pads.

U.S. Pat. No. 5,306,229 to Brandt discloses an elastic articular bandage.

U.S. Pat. No. 5,411,037 to Hess discloses a knee-joint bandage.

U.S. Pat. No. 5,474,524 to Carg discloses a joint support.

U.S. Pat. No. 5,680,657 to Valtakwi discloses protective pads for insertion into pockets to protect from impact while playing sports.

U.S. Pat. No. 5,685,021 to Tsujino discloses protective head gear for wrestlers containing a gel cushioning material.

U.S. Pat. No. 5,695,452 to Grim discloses a formed resilient orthopedic pad.

U.S. Pat. No. 5,769,809 to Witzell discloses a below the joint amputation limb protector.

The following US design patents include pads and protectors for knees and other joints:

U.S. Pat. No. 327,961 to Decker, U.S. Pat. No. 341,005 to Pratt, U.S. Pat. No. 341,229 to Tsuiino, U.S. Pat. Nos. 360,284, 360,285, 360,286 and 360,287 to Pafet, U.S. Pat. No. 363,147 to Chen, U.S. Pat. Nos. 394,332 and 394,333 to Tsujino.

All of the forementioned patents are directed to protecting the knee or other body part from a direct impact. The instant invention is directed to a knee and elbow protector having a specific structure that protects the knee from an oblique, non-direct, or proximal impact. None of these references, either singly or in combination, disclose the instant invention and the benefits derived therefrom.

OBJECTS AND SUMMARY OF THE INVENTION

It is an object of this invention to provide a novel knee protector that is comfortable to wear a and is contured to surround the knee.

It is yet another object of this invention to provide a knee protector that is easily placed around the knee.

It is still another object of this invention to provide a knee protector that provides a unique cushioning effect to protect the knee when impacted.

It is still another object of this invention to provide a knee protector that includes a silicon gel cushioning system to enhance the protection to the knee.

It is another object of this invention to provide a knee protector for use by athletes and the like, that is adapted to prevent injuries to the knee and the proximal anatomical structure associated therewith from oblique, non-direct, and/or proximal impacts.

It is another object of the invention to provide an elastic sleeve to be worn over the leg of an athlete, the sleeve including a pocket enclosure for receiving a novel foam protective element therein, thereby providing protection to the kneecap and the regions surrounding the kneecap.

It is yet another object of the invention to provide securing means to secure the foam protective element assembly in the pocket enclosure in such a fashion to prevent dislocation despite severe impact.

To achieve the foregoing and other advantages, the joint protector of this invention used for protecting an extremity of a person. The protector is predominantly used as a knee and elbow protector. The protector comprises a generally cylindrical elastic member having an outer surface, an inner surface, an upper opening and a lower opening. The elastic member is of a size such that when the extremity is slipped through the upper and lower openings the elastic member snugly encloses the extremity and joint and is held firmnly in place thereon. A pocket enclosure is provided that is located intermediate the outer surface and the inner surface at a location in the elastic member that overlies the joint when the elastic member is slipped over the extremity. A cushioning assembly is provided for cushioning the joint upon impact. The cushioning assembly is located and secured in the pocket enclosure, the pocket enclosure substantially conforming to the shape of the cushioning assembly. The cushioning assembly has an interior surface and an exterior surface, the interior surface being closest to the extremity and joint being protected. The cushioning assembly preferably also includes a central cushioning pad portion having a silicon gel cushioning insert on the interior surface of the pad. The assembly additionally has a top cushioning flap, a bottom cushioning flap, a right side cushioning flap, and a left side cushioning flap radiating from and integral with the central portion. The interior surface of the central portion is shaped to substantially conform to the contour of the joint when snugly covering the joint.

When the protector is slipped over the persons extremity the interior surface of the central pad cushioning portion of the cushioning assembly and, preferably, the silicon gel cushioning insert over lay the joint of the person and the coaction of the cylindrical elastic member, and all of the cushioning flaps causes the cushioning assembly to surround and conform to the contour of the joint to provide protection against both direct and oblique impacts to the joint.

Preferably each cushioning flap has a plurality of apertures that penetrate completely through the cushioning flap. This has the effect of increasing the flexibility of the cushioning flap members as well as their porosity to sweat and the like.

Additionally, the pocket enclosure may include an opening to permit the foam protective element assembly to be removed, which would permit the elastic sleeve to be washed.

With the above and other objects in view, the nature of the invention will be more clearly understood by reference to the following detailed description, the appended claimed subject matter, and the several views illustrated in the accompanying drawings.

DETAILED DESCRIPTION OF THE INVENTION

The novel contoured protective knee and elbow protector of this invention, generally designated 10, includes a central portion 12 with a plurality of radiating cushioning flap members 25, 26, 27,28 is fully illustrated in FIGS. 1–10.

Figure 1:
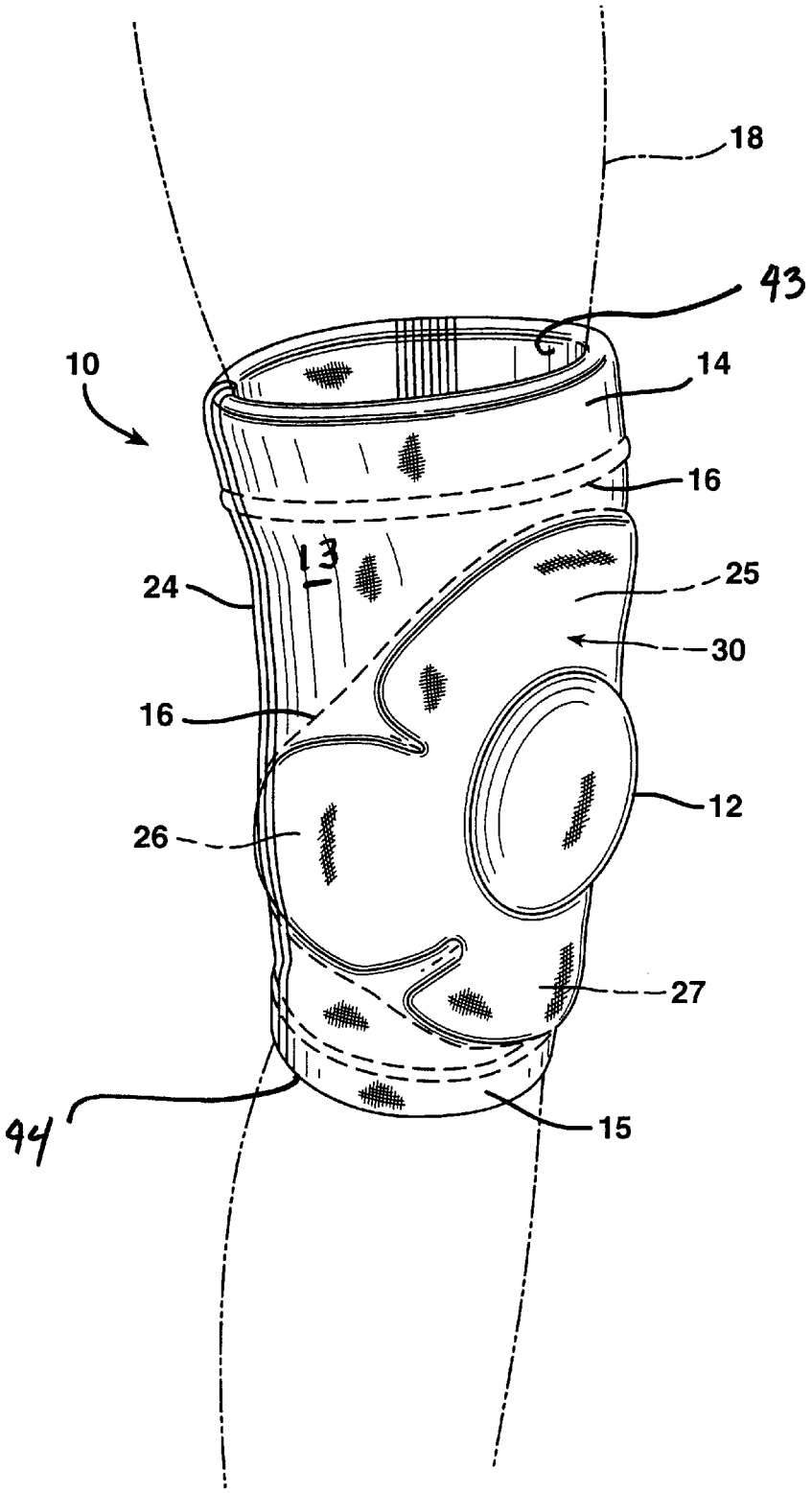
FIG. 1 is a side perspective view of one embodiment of the contoured protective knee and elbow protector of this invention positioned around a person's knee.
Figure 2:
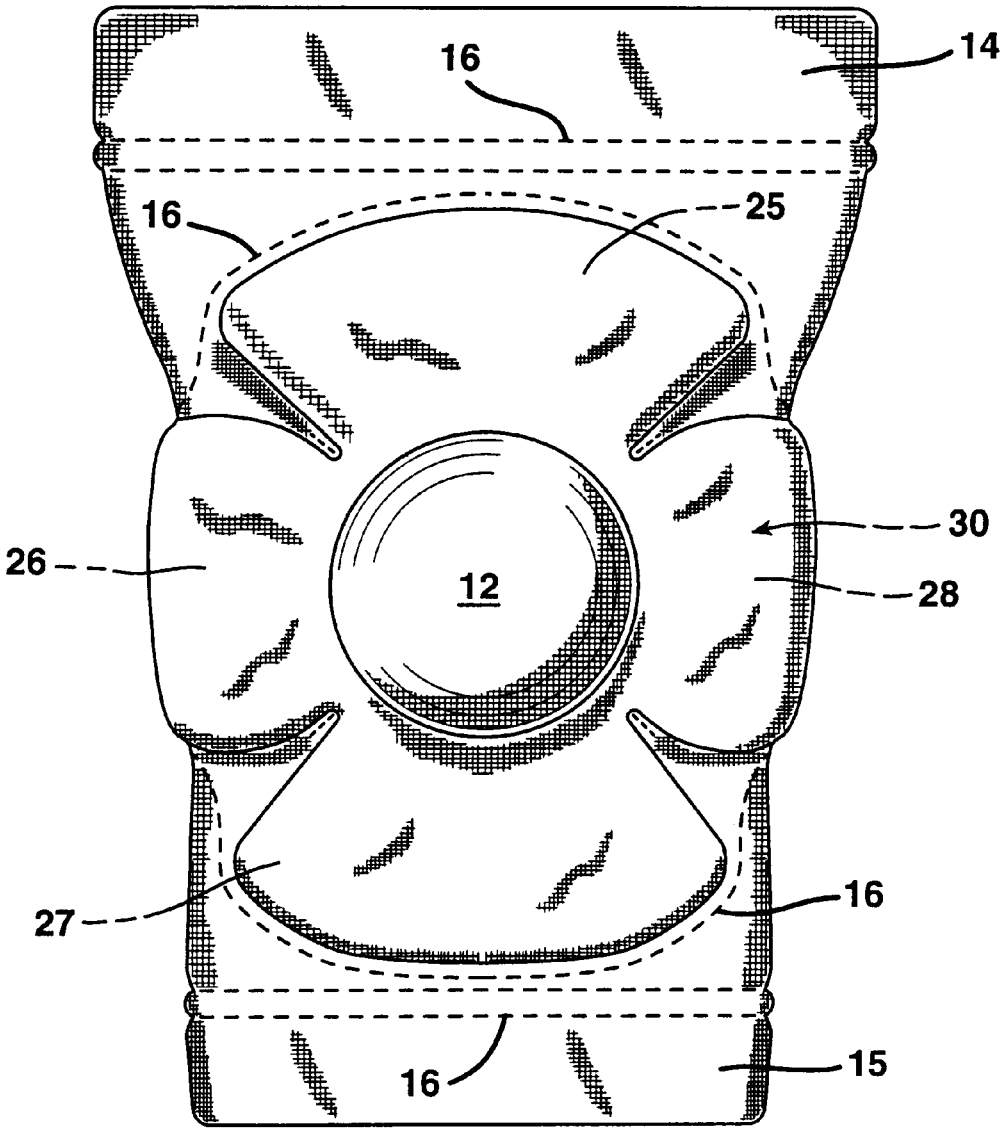
FIG. 2 is a front elevational view of the knee and elbow protector of FIG. 1.
Figure 6:
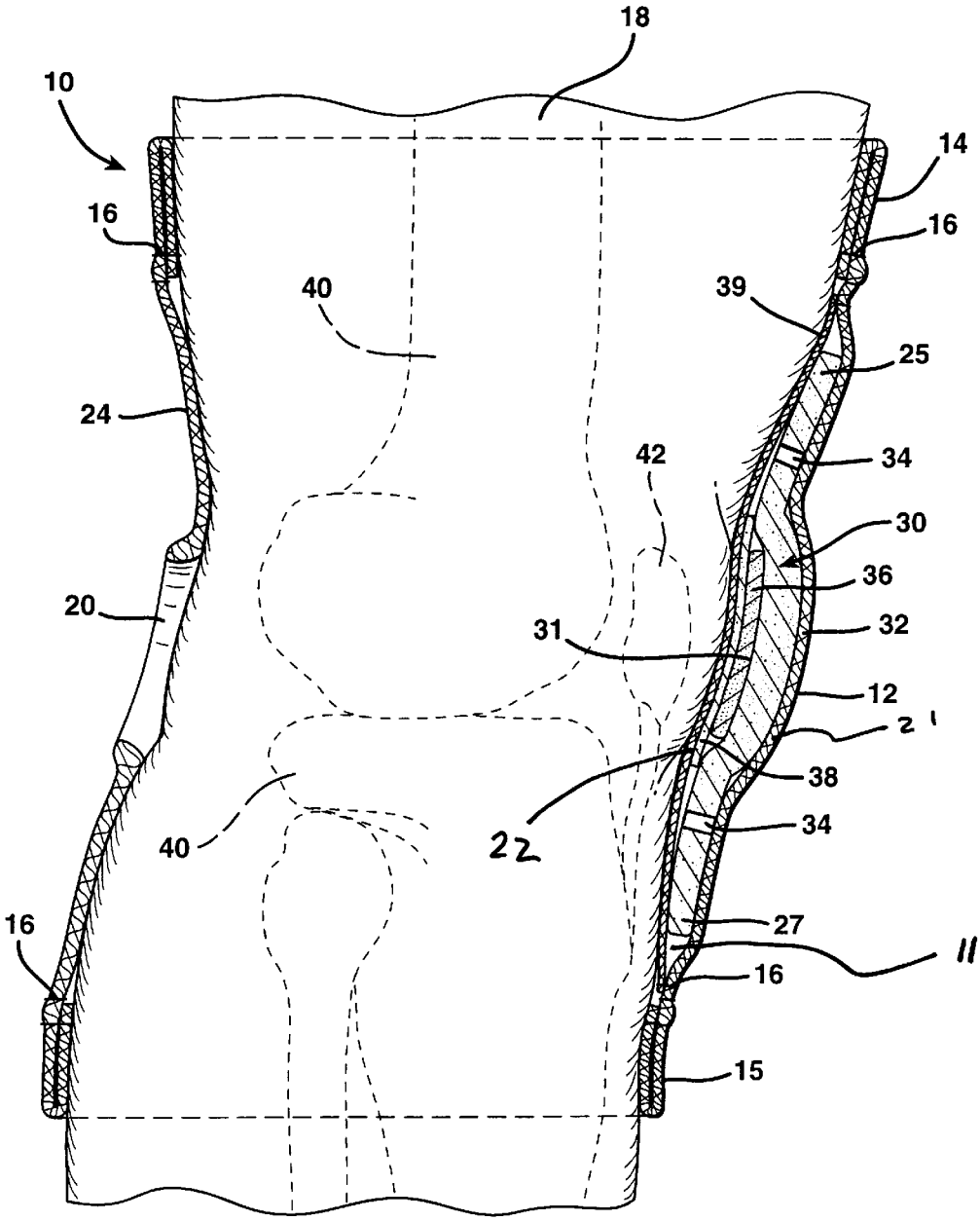
FIG. 6 is a cross-sectional view of the contoured protective knee and elbow protector taken along line 6—6 of FIG. 5.
Figure 9:
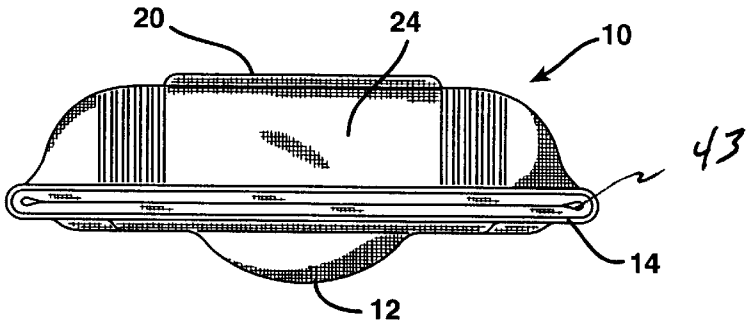
FIG. 9 is a top plan view of the contoured protective knee and elbow protector of this invention.
Figure 10:
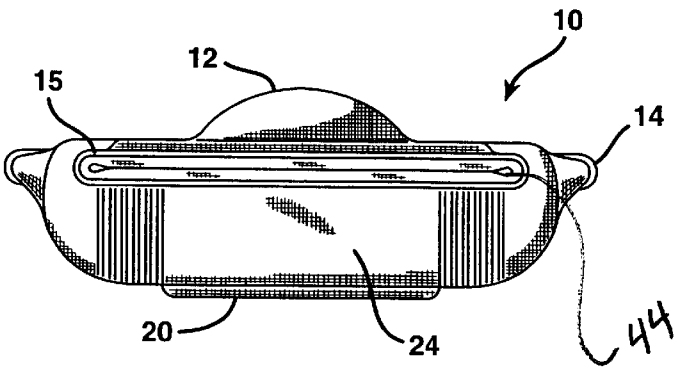
FIG. 10 is a bottom plan view of the contoured protective knee and elbow protector of this invention.
Figure 8:
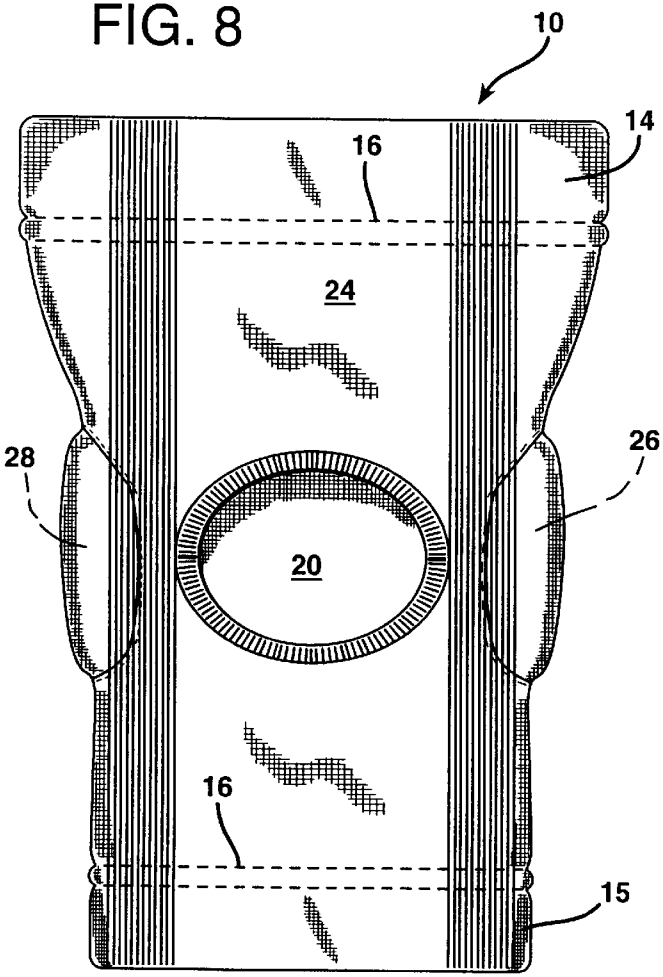
FIG. 8 is a rear elevational view of the contoured protective knee and elbow protector of this invention.

Referring now to FIGS. 1 and 2, the instant knee and elbow protector of this invention 10 is shown being worn about leg 18 of an athlete. The protector 10 includes an elastic cylindrical sleeve 13 including a top portion 14, a bottom portion 15, a back portion 24, and a front portion 23. The top portion 14, bottom portion 15, front portion 23, and back portion 24 may be made of any of a variety of elastic materials. Referring to FIGS. 6 and 8, an aperture 20 may be centrally disposed 10 midway on the back portion 24 of the elastic sleeve, approximately halfway between the top portion 14 and the bottom portion 15. A top opening 43 and a bottom opening 44 are present in the elastic sleeve and are best shown in FIGS. 1, 9 & 10. The top opening 43 and the bottom opening 44 are designed to receive the athlete's leg 18 therethrough.

Figure 7:
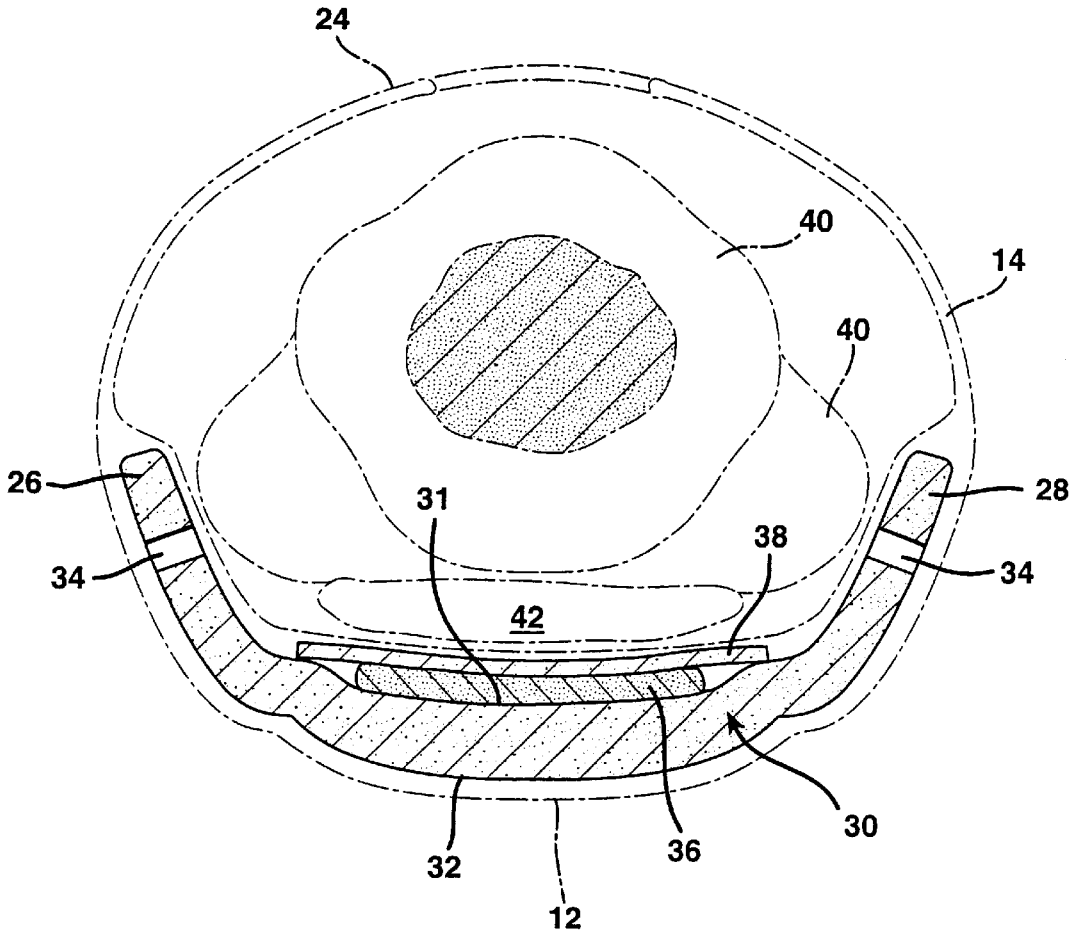
FIG. 7 is a cross-sectional view of the contoured protective knee and elbow protector taken along line 7—7 of FIG. 5.

Referring to FIGS. 6 and 7, a pocket enclosure 11 receives a foam protective cushioning assembly 30. The pocket enclosure 11 is formed by a front 21 and a rear 22 portion of the cylindrical sleeve 13 and is secured and surrounded by stitching 16 that secures the cushioning assembly 30 therein. Additional stitching 16 is shown near the top portion 14 and the bottom portion 15. This stitching 16 permits the elastic sleeve to maintain it's generally cylindrical configuration as well as providing extra support to permit the sleeve 13 to remain in the correct position on the athlete's leg.

Figure 3:
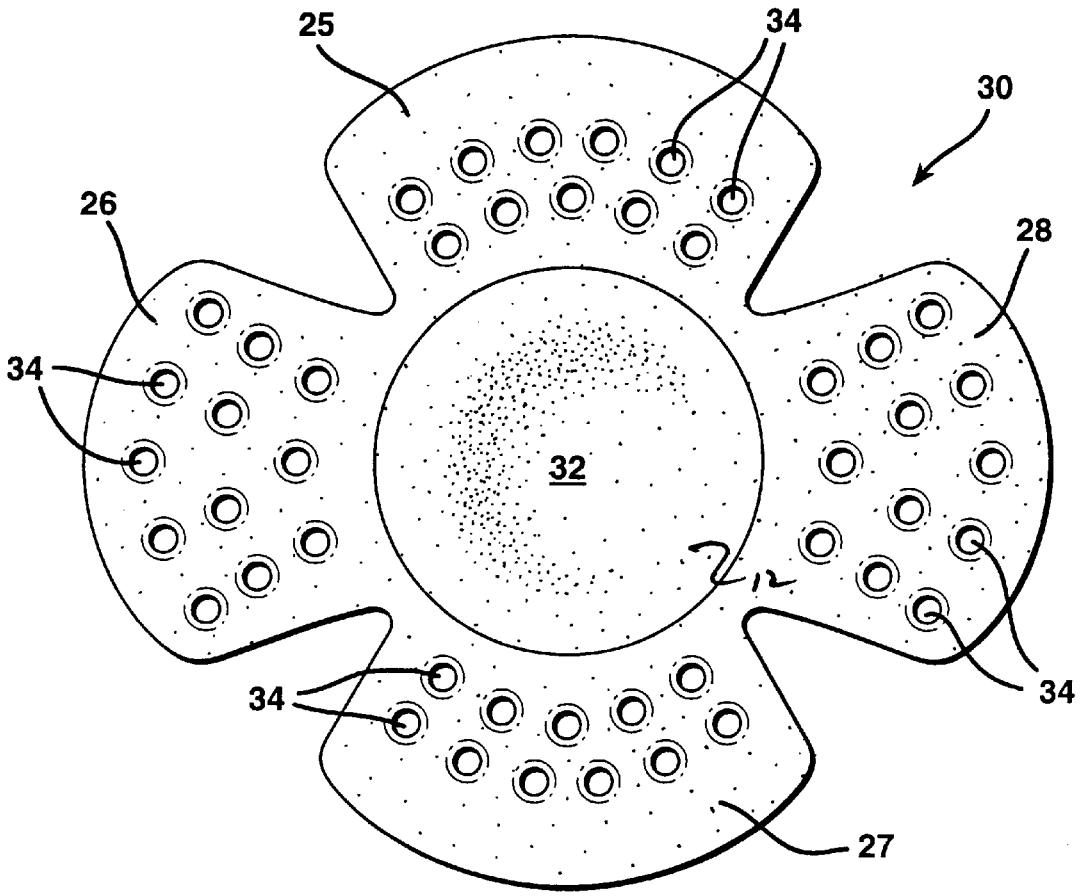
FIG. 3 is a front view of the foam protective element assembly which is placed inside the pocket enclosure of the knee and elbow protector.
Figure 4:
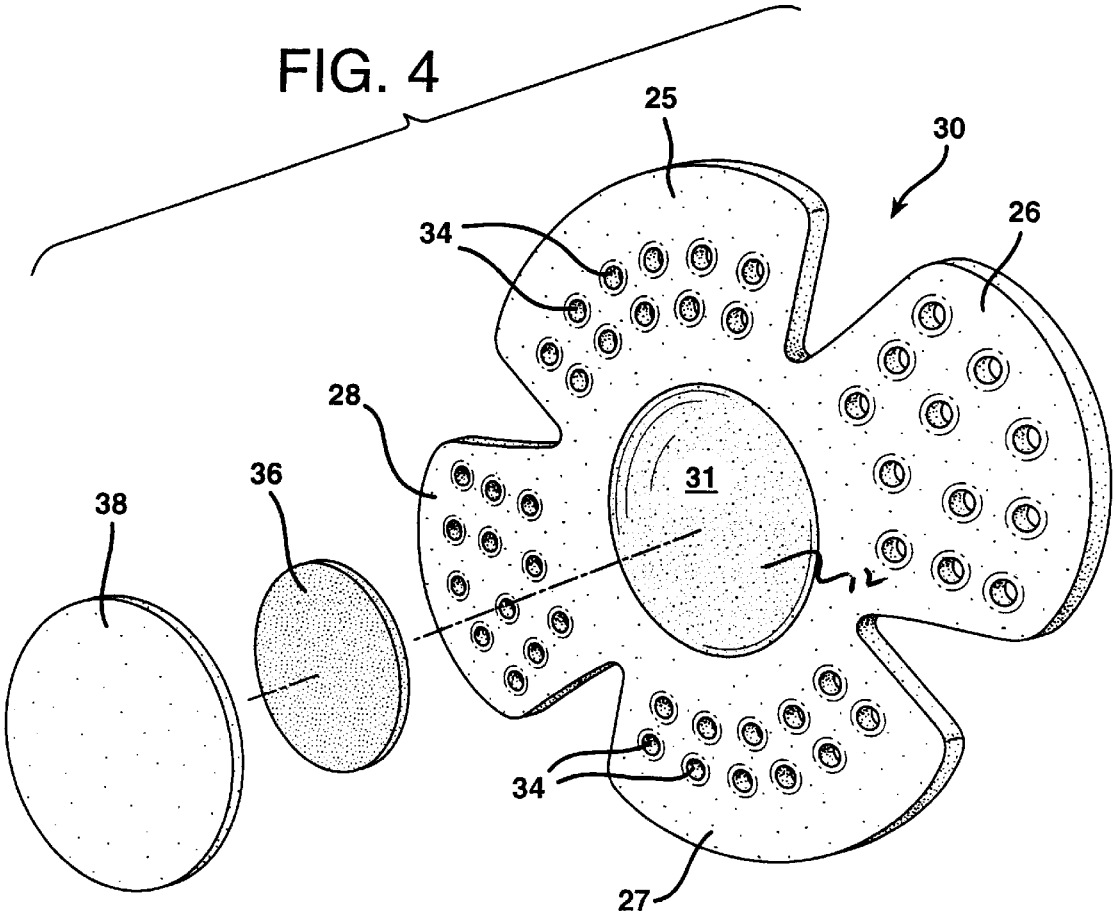
FIG. 4 is a schematic break-away view showing the structure of the foam protective element assembly of FIG. 3.

Referring, for example, to FIGS. 2, 3 and 4, the foam protective cushioning assembly 30 includes a central portion 12, a top cushioning flap 25, a left cushioning flap 26, a bottom cushioning flap 27 and a right cushioning flap 28. Each of the cushioning flap elements are integrally affixed to the central portion 12 and are approximately spaced ninety degrees apart. Cushioning assembly 30 may include more or less than four cushioning flaps. In such an instance, the angular displacement between each of the cushioning flaps would be different, for instance, in the case of three cushioning flap elements, the degree of separation would be about one hundred and twenty degrees.

Referring to FIGS. 3, 4, 6 and 7 the foam protective cushioning assembly 30 includes a central portion 12 that has an outer convex curved portion 32 and an inner concave portion 31. The inner concave portion 31 includes a silicone gel-foam insert 36 therein covered by an outer layer of foam 38, i.e. foam cover 38. Radiating from the central portion 12 of the foam protective cushioning assembly 30 is a top cushioning flap 25, a left cushioning flap 26, a bottom cushioning flap 27, and a right cushioning flap 28. Each of the cushioning flaps (25, 26, 27, 28) is integral and continuous with the central portion 12, e.g., they are stamped from or molded into one piece of foam. Each of the cushioning flaps (25, 26, 27, 28) has a plurality of apertures or holes 34 passing therethrough. These holes impart flexibility as well as a porosity to the cushioning flap elements 25, 26, 27, 28. The 10 foam protective cushioning assembly 30 is retained within the pocket enclosure 11 located within the elastic cylindrical sleeve 13.

Figure 5:
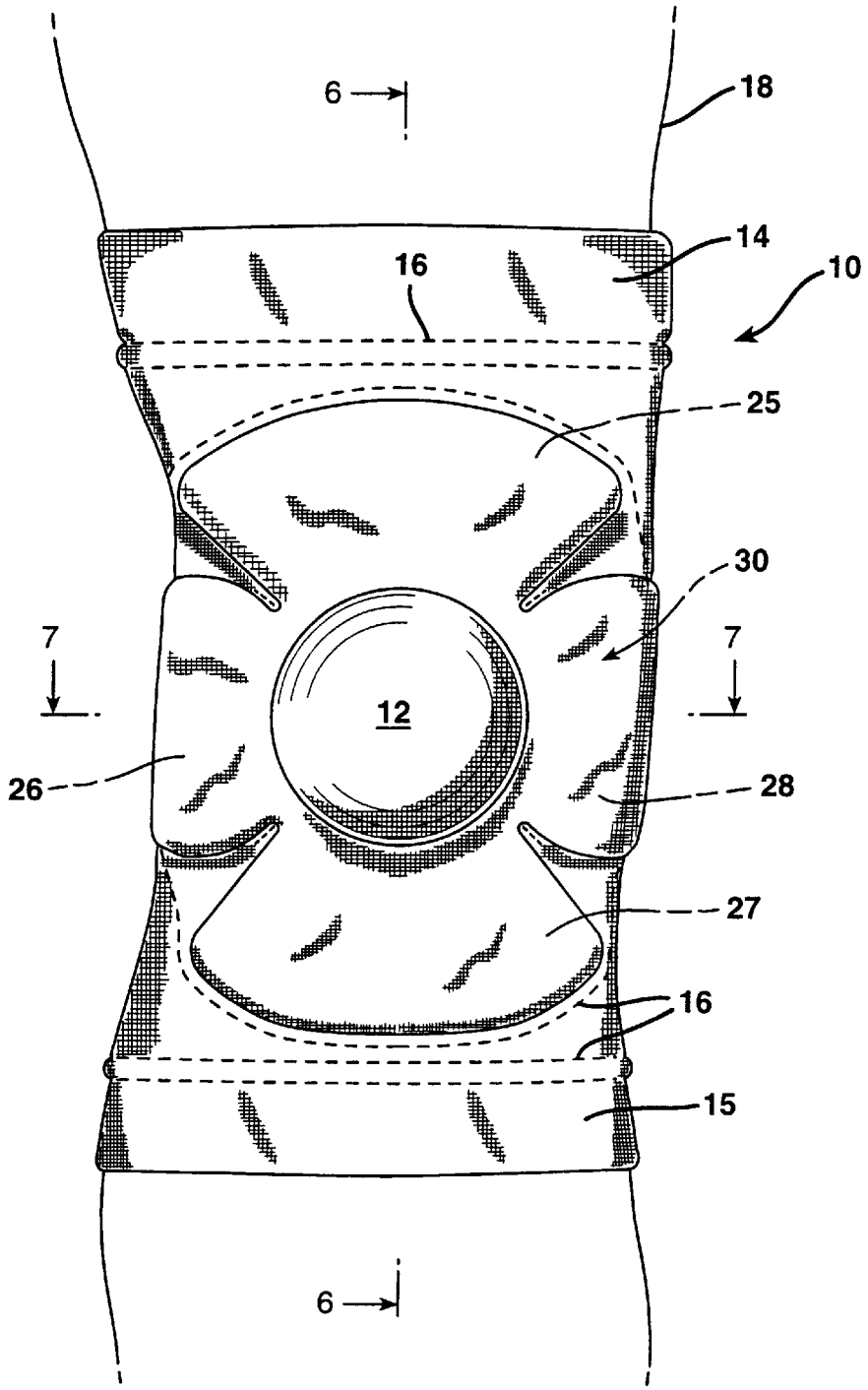
FIG. 5 is a front elevational view of the contoured protective knee and elbow protector positioned around a person's knee.

FIG. 6 is a cross-sectional view of the contoured protective joint protector of this invention taken along line 6—6 of FIG. 5 shown protecting a knee cap 42. The knee cap 42 is shown being protected by the foam protective cushioning assembly 30 located therein. Additional bones 40 located proximal to the knee cap 42 are shown in dashed lines. The elastic cylindrical sleeve 13 is shown surrounding the athlete's leg 18. From this cross-sectional view, the central portion 12 includes an outer layer of the sleeve 13 that includes an outside curved portion 32, an inner concave portion 31, a foam cover 38 and a silicone gel-foam insert 36 therebetween.

FIG. 7 is a cross-sectional view of the contoured protective joint, e.g., knee and elbow protector of this invention on a knee taken along line 7—7 of FIG. 5. The knee cap 42 is shown being protected by the foam protective cushioning assembly 30. Additional views of bones 40 located proximal to the knee cap 42 are also shown in dashed lines. From this cross-sectional view, the central portion 12 includes an outer layer which has an outside curved portion 32. This view shows how the four cushioning flap elements 2528 conform to the region surrounding the kneecap 42 to protect against direct, side and oblique impacts against the kneecap 42.

FIG. 8 is a rear elevational view of the joint protector of this invention 10. The aperture 20 in the rear of the elastic sleeve is clearly shown. The left cushioning flap element 26 and right cushioning flap element 28 are of course reversed as this is a rear view. The stitching 16 is shown at the top 14 and bottom 15 of the protector. As perhaps best seen in FIG. 6, this stitching 16 secures an upper portion 14 and a lower portion 15 of the elastic cylindrical sleeve 13 as they are folded about the top opening 43 and bottom opening 44 respectively. This gives a better defined end portion and reduces the possibility of fraying.

FIG. 9 is a top plan view of the contoured protective knee and elbow protector 10 of this invention. The central portion 12 is shown as well as the top opening 43 proximal the top 14 of the knee and elbow protector 10. The back of the knee pad 24 and the aperture 20 are also shown.

FIG. 10 is a bottom plan view of the contoured protective knee and elbow protector of this invention. The central portion 12 is shown as well as the bottom opening 44 near the bottom 15 of the knee and elbow protector 10. The back of the knee pad 24 and the aperture 20 are also shown in this figure.

While the present invention has been shown in the drawings and fully described above with particularity and detail in connection with what is presently deemed to be the most practical and preferred versions of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed is:

1. A joint protector for an extremity of a person comprising:

a) a generally cylindrical elastic member having an outer surface, an inner surface, an upper opening and a lower opening, the elastic member of a size such that when the extremity is slipped through the upper and lower openings the elastic member snugly encloses the extremity and joint and is held firmly in place thereon;

b) a pocket enclosure located intermediate the outer surface and the inner surface at a location in the elastic member that overlies the joint when the elastic member is slipped over the extremity;

c) a cushioning assembly for cushioning the joint upon impact located and secured in the pocket enclosure, the cushioning assembly having an interior surface and an exterior surface, the interior surface being closest to the extremity and joint, the assembly comprising a central cushioning pad portion and a top cushioning flap, a bottom cushioning flap, a right side cushioning flap, and a left side cushioning flap radiating from and integral with the central portion, the interior surface of the central portion shaped to substantially conform to the contour of the joint when snugly covering the joint, wherein the central cushioning pad portion has a silicon gel cushioning insert on the interior surface of the pad; wherein when the protector is slipped over the persons extremity the interior surface to the central pad cushioning portion of the cushioning assembly over lays the joint of the person and the coaction of the cylindrical elastic member, and all of the cushioning flaps cases the cushioning assembly to surround and conform to the contour of the joint to provide protection against both direct and oblique impacts to the joint.

2. The joint protector as claimed in claim 1 wherein each of the cushioning flaps has a plurality of apertures therethrough.

3. The joint protector as claimed in claim 1, wherein the pocket enclosure substantially conforms to the shape of the cushioning assembly.

4. A joint protector for an extremity of a person comprising:

a) a generally cylindrical elastic member having an outer surface, an inner surface, an upper opening and a lower opening, the elastic member of a size such that when the extremity is slipped through the upper and lower openings the elastic member snugly encloses the extremity and joint and is held firmly in place thereon;

b) a pocket enclosure located intermediate the outer surface and the inner surface at a location in the elastic member that overlies the joint when the elastic member is slipped over the extremity;

c) a cushioning assembly for cushioning the joint upon impact located and secured in the pocket enclosure, the pocket enclosure substantially conforming to the shape of the cushioning assembly, the cushioning assembly having an interior surface and an exterior surface, the interior surface being closest to the extremity and joint, the assembly comprising a central cushioning pad portion having a silicon gel cushioning insert on the interior surface of the pad, and a top cushioning flap, a bottom cushioning flap, a right side cushioning flap, and a left side cushioning flap radiating from and integral with the central portion, the interior surface of the central portion shaped to substantially conform to the contour of the joint when snugly covering the joint;

wherein when the protector is slipped over the persons extremity the interior surface of the central pad cushioning portion of the cushioning assembly and the silicon gel cushioning insert over lay the joint of the person and the coaction of the cylindrical elastic member, and all of the cushioning flaps causes the cushioning assembly to surround and conform to the contour of the joint to provide protection against both direct and oblique impacts to the joint.

* * * * *